US006308637B1

(12) United States Patent
Sheets et al.

(10) Patent No.: US 6,308,637 B1
(45) Date of Patent: Oct. 30, 2001

(54) PIVOTAL PUSHER DOG FOR OVERHEAD I-BEAM CONVEYOR SYSTEM

(75) Inventors: Kenneth E. Sheets; James Burke; Steve Sheets, all of Louisville, KY (US)

(73) Assignee: Rapid Industries, Inc., Louisville, KY (US)

( * ) Notice: Subject to any disclaimer, the term of this patent is extended or adjusted under 35 U.S.C. 154(b) by 0 days.

(21) Appl. No.: 09/687,388

(22) Filed: Oct. 13, 2000

Related U.S. Application Data

(60) Provisional application No. 60/160,039, filed on Oct. 18, 1999.

(51) Int. Cl.[7] ..... B61B 3/00
(52) U.S. Cl. ..... 104/172.4
(58) Field of Search ..... 104/172.1, 172.2, 104/172.3, 172.4, 172.5

(56) References Cited

U.S. PATENT DOCUMENTS

| | | | | |
|---|---|---|---|---|
| 3,667,399 | * | 6/1972 | Czarnecki | 104/172.4 |
| 3,744,432 | | 7/1973 | Price et al. . | |
| 3,774,546 | * | 11/1973 | Krammer | 104/172.3 |
| 3,800,709 | | 4/1974 | De Good et al. . | |
| 3,948,186 | | 4/1976 | McCaul . | |
| 4,031,829 | | 6/1977 | Bell et al. . | |
| 4,058,064 | | 11/1977 | Wilder et al. . | |
| 4,070,972 | | 1/1978 | Folsom et al. . | |
| 4,073,237 | * | 2/1978 | Wakabayashi | 104/172.4 |
| 4,223,610 | | 9/1980 | Lempio . | |
| 4,354,435 | | 10/1982 | Wakabayashi . | |
| 4,424,749 | | 1/1984 | Wakabayashi . | |
| 4,461,216 | | 7/1984 | Carney . | |
| 4,483,252 | | 11/1984 | Pierson . | |
| 4,614,158 | | 9/1986 | Helde . | |
| 4,790,247 | * | 12/1988 | Summa | 104/172.2 |
| 4,947,758 | | 8/1990 | Kuchta . | |
| 5,507,233 | | 4/1996 | Kwon et al. . | |

* cited by examiner

*Primary Examiner*—Mark T. Le
(74) *Attorney, Agent, or Firm*—Maurice L. Miller, Jr.

(57) ABSTRACT

A two-track conveyor system includes an I-beam-shaped power track and a channel-shaped free track, where the power track supports a heavy-duty chain drive having a pusher dog with a pivotal connector. By providing the pusher dog with the pivotal connector the pusher dog can be used with a load-bearing trolley, that rides within the free track, that has a fixed power dog at the front end of the leading trolley and that does not require a hold back dog.

3 Claims, 5 Drawing Sheets

PIVOTAL PUSHER DOG FOR OVERHEAD I-BEAM CONVEYOR SYSTEM

CROSS-REFERENCE TO RELATED APPLICATION

This application claims priority from U.S. Provisional Application Ser. No. 60/160,039, filed Oct. 18, 1999, which application is incorporated herein by reference in its entirety.

BACKGROUND

The present invention relates to a flexible pusher dog for a power chain driven overhead conveyor system.

Cost-efficient automated production facilities depend heavily on the versatility, dependability and performance of their conveyor systems. To minimize the use of valuable floor space, overhead conveyor systems are commonly used. These overhead systems can be configured to include changes in elevation, cornering and diagonal banking, without requiring major modifications to the floor plan of the production facility. Spur lines can be added for additional flexibility. Examples of a couple common overhead conveyor systems are described in U.S. Pat. Nos. 3,744,432, 3,948,186 and 4,223,610, which are incorporated herein by reference.

Two types of overhead conveyors are commonly used. Both types of conveyors use two-track systems, each having an upper power track and a lower free track, and are designed to support and move load-bearing trolleys along the overhead systems. Normally, at least two load-bearing trolleys—a leading trolley and a trailing trolley—are used to support each load. In both types of conveyors, the trolleys are carried by a lower channel-shaped free track, i.e. the wheels of the trolleys ride within the free track. Because the free track does not include any type of drive system, without some external force, trolleys supported by the free track remain stationary.

The drive force for the trolleys is found in the upper power tracks. In one type of conveyor system, a drive chain—such as a universal link drive chain which features alternating vertical load wheels and horizontal guide wheels—is threaded through a channel-shaped upper power track. Because the drive chain is enclosed in the power track, the chain is protected from dirt and debris thereby reducing maintenance costs and prolonging chain life. A second type of conveyor uses an I-beam shaped upper power track. A strong but flexible drive chain, such as an X-348 chain, is suspended from the upper power track by chain support trolleys. Although the drive chain in this type of system is exposed to the environment, the use of the I-beam to support the chain allows the conveyor to carry heavier loads than can be accommodated with the channel-shaped track systems.

In both types of conveyors, projections—referred to as pusher dogs—are suspended from the respective drive chain. With the universal link drive chain, typically a drop-forged pusher dog, such as shown in FIG. 1, is suspended from a universal link. The drop-forged pusher dog (510) includes a pivoted connector (512), having a hook (514) and a recessed stop (516), attached to the universal link (511) by a pivot pin (518). The leading trolley (520) includes a non-retractable flange (522), or power dog, which can be engaged by the pusher dog (510) to move the leading load-bearing trolley (520), and hence to move the load. When the load is being pulled forward the hook (514) of the pusher dog (510) engages the flange (522) of the lead trolley (520) causing the trolley (520) to move. However, when the load is on a slight downward slope, such that the load can move without being pulled by the pusher dog (510), the recessed stop (516) engages the flange (522) to keep the load from moving along the conveyor at an uncontrollable rate. When the leading trolley (520) reaches a predetermined position along the track, the connector (512) can be forced to pivot away from the power dog (522) thereby preventing further movement of the load. For example, as the leading trolley (520) approaches a stopped trailing trolley (524), a beaver tail (526) on the trailing trolley (524) causes the connector (512) to pivot away from the power dog (522). Without a driving force to move the leading trolley (520), the load stops its forward movement.

The heavy-duty link chain used in the I-beam conveyor system has not been previously used to support a drop-forged type pusher dog. Rather, as shown in FIG. 2, the pusher dogs for these systems have been limited to simple side-link pusher dogs (550), or simple pivotal pusher dogs such as shown in U.S. Pat. Nos. 4,243,325 and 4,424,749, incorporated herein by reference. These pusher dogs require a leading trolley (560) to have a relatively complicated engagement system that includes a pivotal power dog (562) at the front end of the leading trolley (560) and a pivotal hold back dog (564) at the rear end of the leading trolley (560). When the load is being pulled forward, the sidelink pusher dog (550) engages the power dog (562) to drive the trolley (560). However, when the load is on a downward slope, the contact between the pusher dog (550) and the power dog (562) is broken, and the pusher dog (550) instead engages with the hold back dog (564), thereby preventing the trolley from moving forward too rapidly. When the trolley (560) approaches a stopped object, a stop blade (566), attached for example to a trailing trolley (568), breaks the connection between the pusher dog (550) and the power dog (562), thereby preventing any further movement of the load.

Because the I-beam type of conveyor can carry heavier loads than the channel type conveyor but the channel type conveyor allows the use of the simpler non-retractable power dog on its trolleys, it would be beneficial to have an overhead conveyor system that uses an I-beam power track, with a pusher dog that can pivot away from the load-bearing trolley, thereby allowing the conveyor to use a leading trolley with a fixed power dog. Such a design could provide cost savings to the user from both an initial cost and equipment maintenance basis.

SUMMARY OF THE PREFERRED EMBODIMENT

The present invention describes a pusher dog that has a pivotal connector and that is incorporated within a heavy-duty chain drive for use with for an I-beam-shaped power track. By providing the pusher dog with the pivotal connector the pusher dog can be used with a load-bearing trolley, that rides within a channel-shaped free track, that has a fixed power dog at the front end of the leading trolley and that does not require a hold back dog.

DETAILED DESCRIPTION OF THE PREFERRED EMBODIMENTS

The overhead conveyor pusher dog, depicted in the various Figures is selected solely for the purposes of illustrating the invention. Other and different pusher dogs may utilize the inventive features described herein as well.

Figure 1:
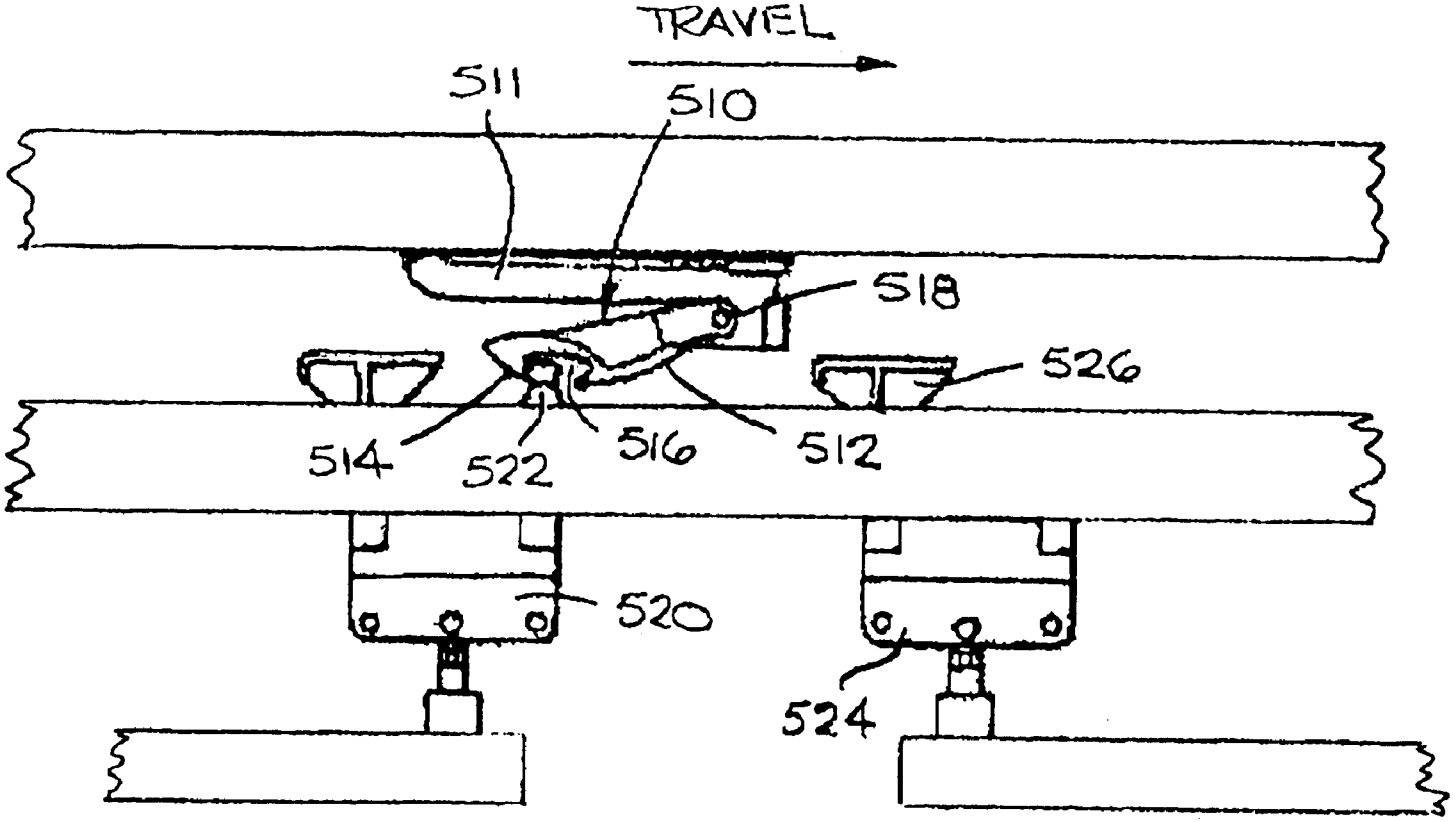
PRIOR ART FIG. 1
FIG. 1 is a side view of a channel-type conveyor system having a universal link chain drive with a prior art pusher dog, and a fixed power dog leading trolley.
Figure 2:
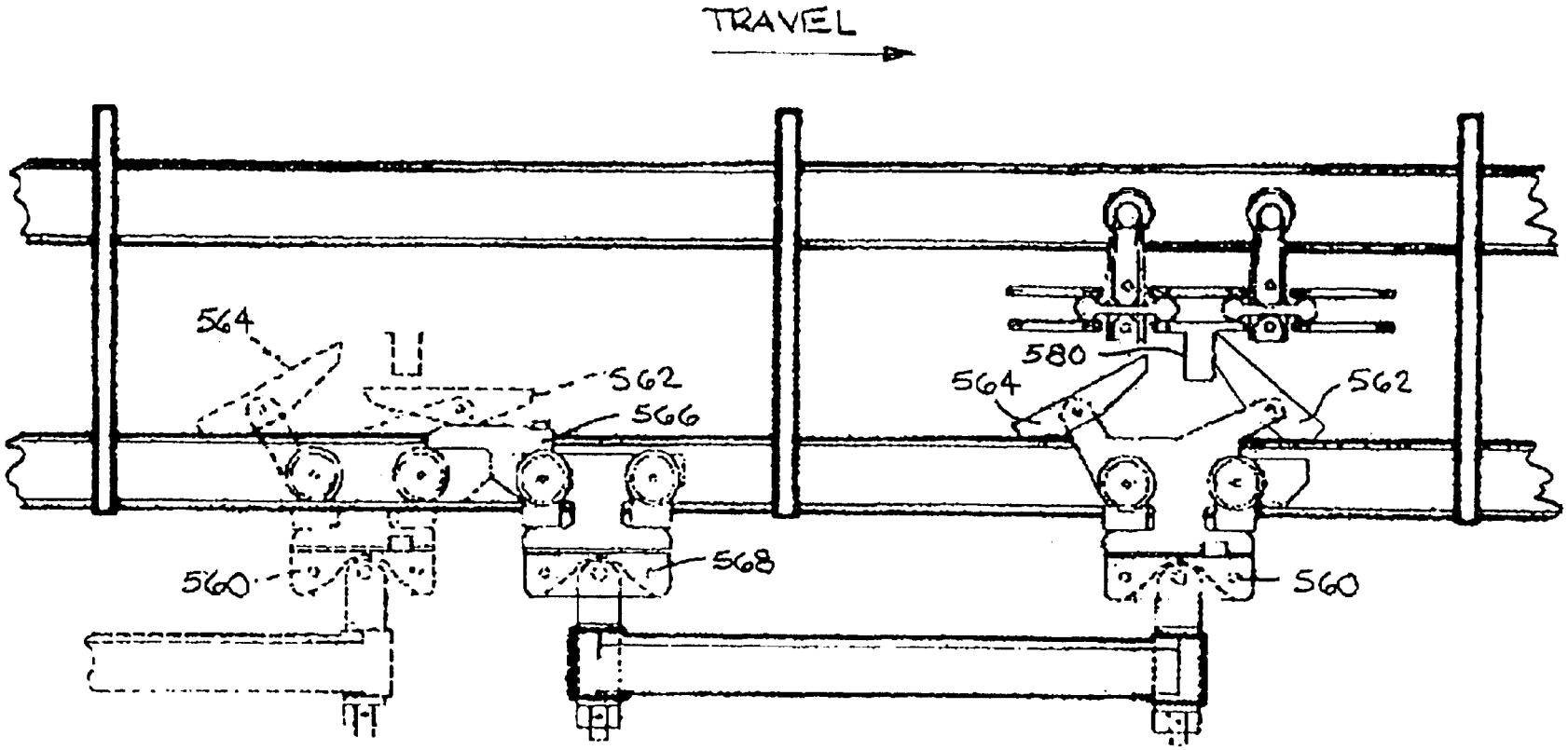
PRIOR ART FIG. 2
FIG. 2 is a side view of an I-beam type conveyor system having a heavy-duty chain drive with a prior art pusher dog, and a pivotal power dog leading trolley.
Figure 3:
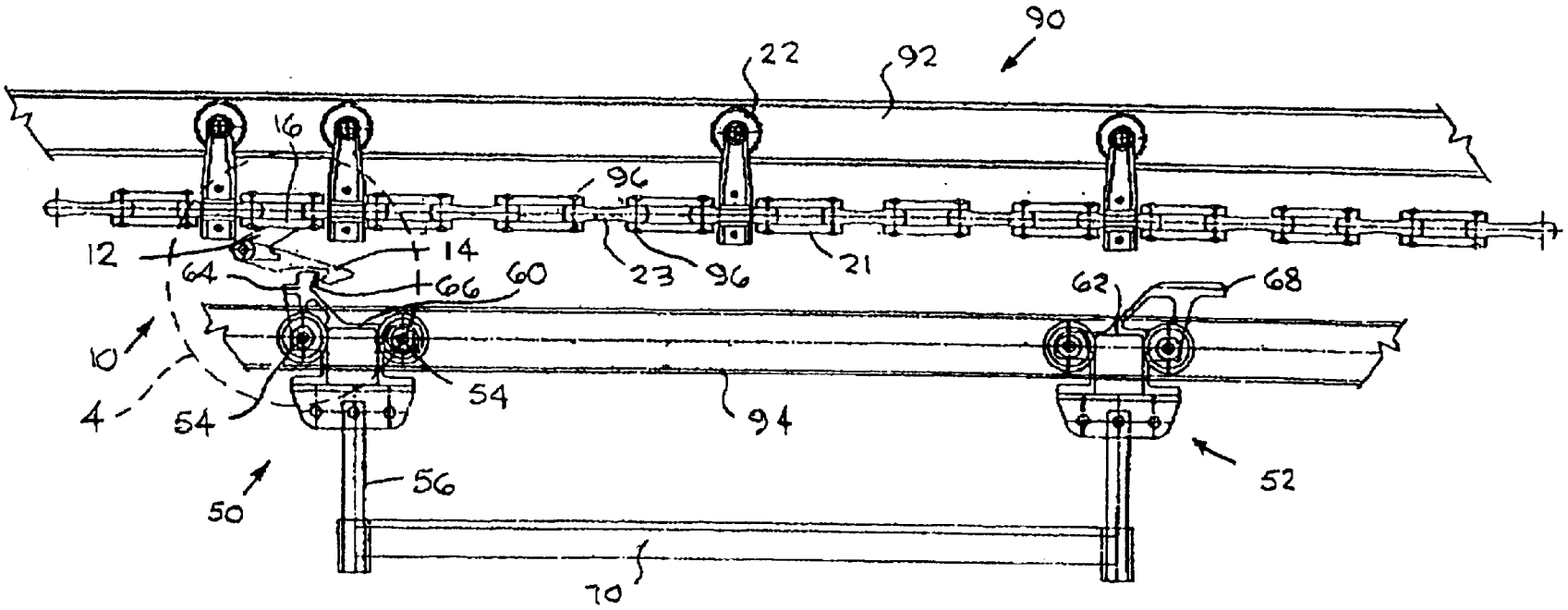
FIG. 3 is a side perspective view of an overhead conveyor including a pivotal pusher dog made in accordance with the present invention.
Figure 4:
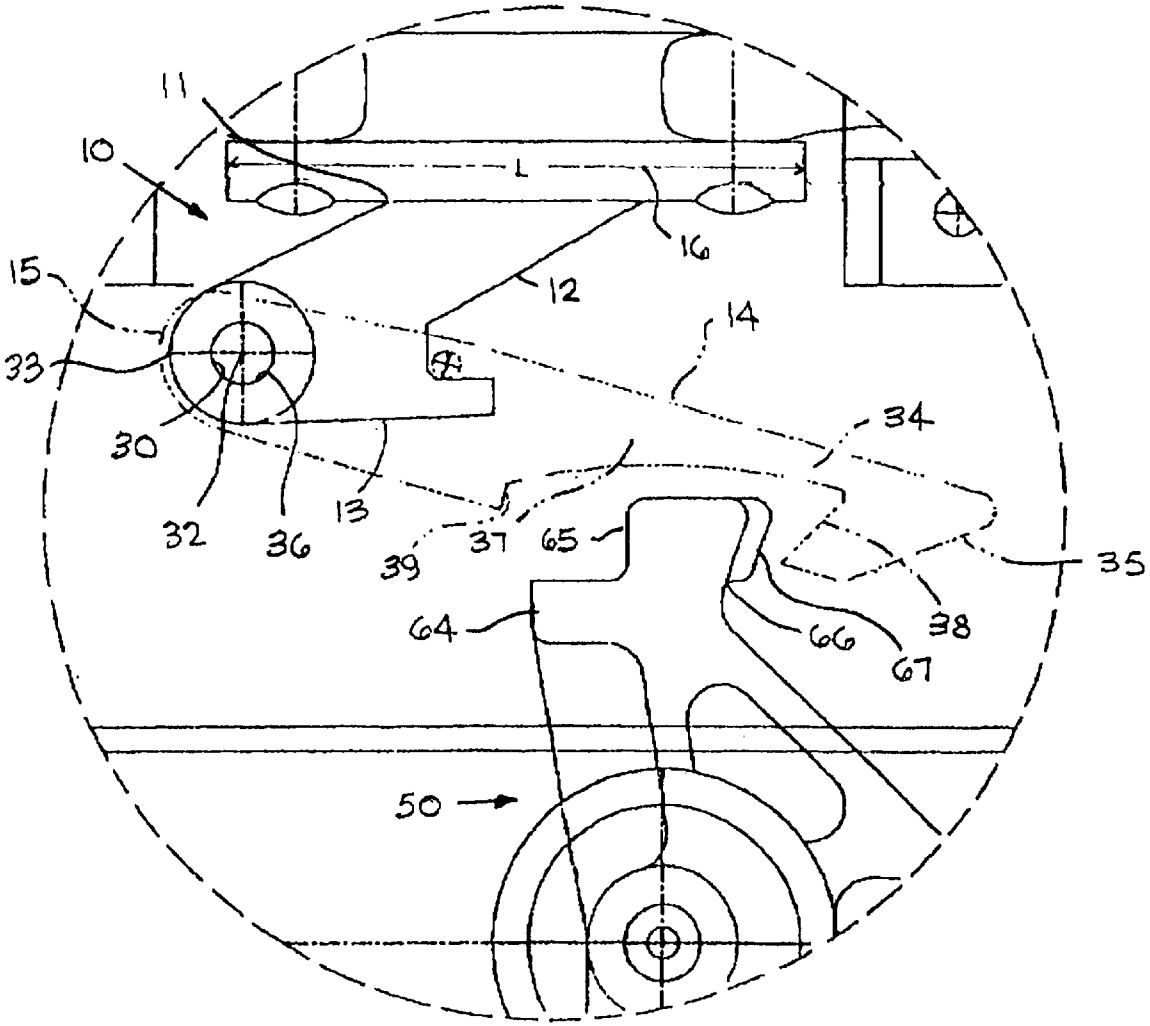
FIG. 4 is a side view of a section of the overhead conveyor including the pusher dog and leading load-bearing trolley of FIG. 3.
Figure 5:
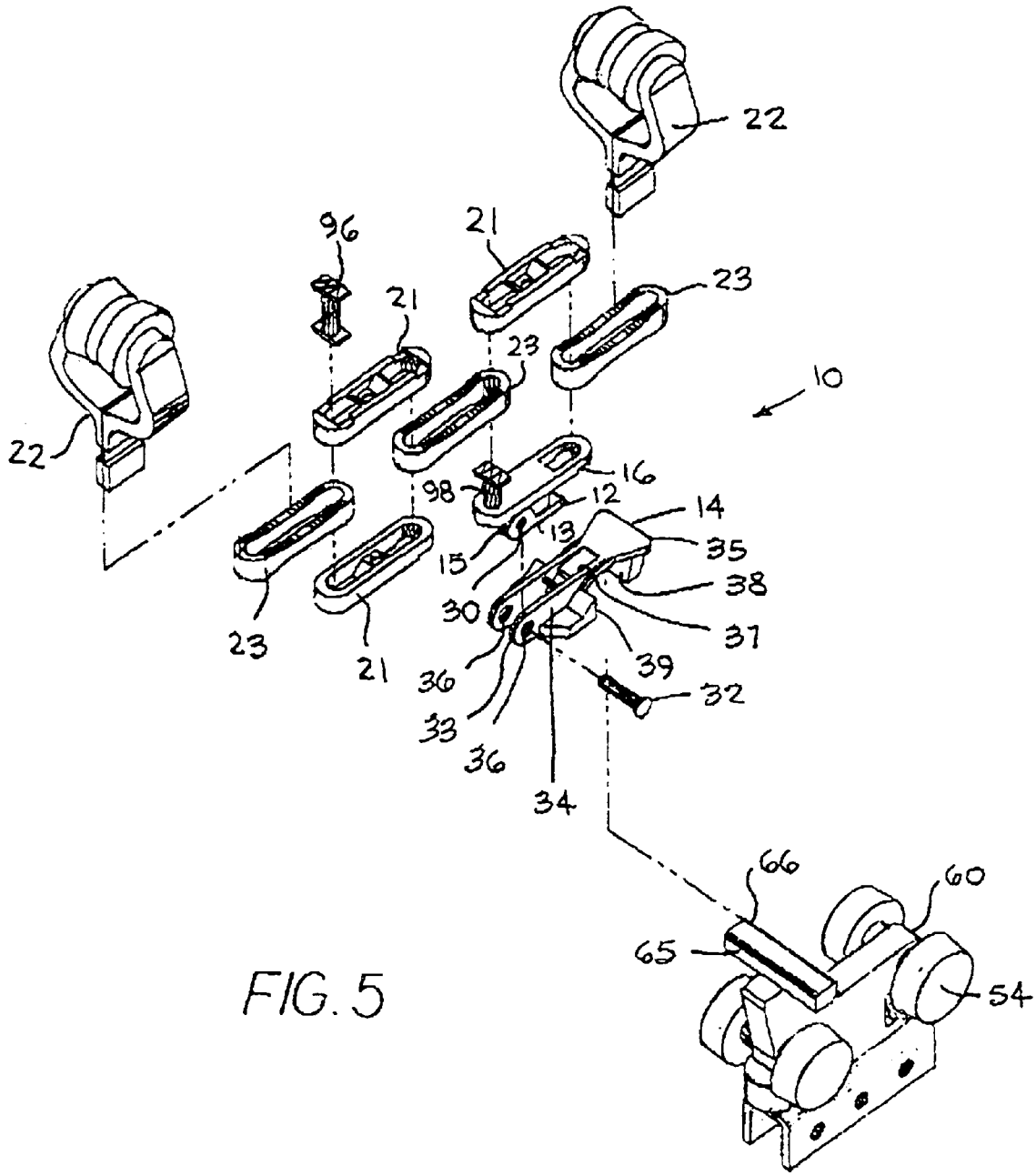
FIG. 5 is an exploded view of the pusher dog and leading load-bearing trolley of FIG. 3.

Reference is first made to FIGS. 3 through 5 in which the overhead conveyor pusher dog constructed in accordance with the present invention is generally noted by the character numeral 10. The pusher dog 10 has as major components a tooth 12, a pivotal connector 14, having a hook 38 and a recessed stop 39, and a chain side link 16.

As shown in FIG. 3, the pusher dog 10 is intended to be used with a two-track overhead conveyor system 90 that includes an I-beam power track 92 and a channel-shaped free track 94. A strong but flexible drive chain 20, such as an X-348 chain, an X-458 chain, an X-678 chain, or a chain of similar strength, having a series of horizontal links 21 and vertical links 23 held together by pins 96—as is known in the art—is suspended from the power track 92 by chain support trolleys 22. One or more pusher dogs 10 can be incorporated into the conveyor chain 20 by having each pusher dog 10 replace one horizontal link 21, with the connector 14 of the pusher dog 10 extending away from the power track 92.

The free track 94 of the conveyor normally carries at least one leading load-bearing trolley 50, and may further carry one or more trailing load-bearing trolleys 52, the number and type of trolleys 50, 52 being determined by the load 70 and the requirements of the user. In the embodiment shown two trolleys—a leading trolley 50 and a trailing trolley 52—are used to support the load 70. The leading trolley 50 includes a body 60 mounted to a pair of ball bearing wheels 54 that fit within the free track 94, a king pin 56 that projects away from the power track 92 attached to the body 60, and a non-retractable flange or power dog 64 which extends from the body 60 toward the power track 92. The power dog 64 includes a key 66, having a front edge 65 and a rear edge 67. The rear edge 67 can be engaged by the hook 38 of the connector 14 to move the leading trolley 50, and hence to move the load 70 forward. Alternatively, the front edge 65 of the key 66 can be engaged by the recessed stop 39 of the connector 14 to prevent the leading trolley 50 from moving along the conveyor at too rapid a rate. The trailing trolley 52 is similar to the leading trolley 50 except a "beaver-tail" type flange 68, as is commonly known in the art, projects from the body 62 toward the power track 92 replacing the key 66.

As shown in FIGS. 4 and 5, the pusher dog 10 includes a tooth 12, a pivotal connector 14. and a chain side link 16, having a length "L". The tooth 12 has a first and a second end 11, 13, and is fixedly attached by the tooth's first end 11 to the chain side link 16. At the tooth's second end 13, a channel 30 extends through the tooth 12, with the channel 30 being oriented such that it is essentially perpendicular to the length "L" of the side link 16. The tooth 12 can vary in size, in shape, and in orientation relative to the side link 16; the channel 30 can vary with respect to where it is positioned on the tooth 12 and can also vary in diameter. In the preferred embodiment, the tooth 12 is angled slightly so that the second end 13 extends forward of the first end 11, and the channel 30 is positioned at a leading edge 15 of the second end 13. The tooth 12 is held to the drive chain 20 by replacing a vertical link 21. The tooth 12 and side link 16 can be held in position by using a standard pin 96, as is known in the art, or a pin 98 may be permanently affixed to the tooth 12 and side link 16, as is shown in FIG. 5.

Referring to FIGS. 4 and 5, the pivotal connector 14 has a head 33, a body 34, and a tail 35. The head 33 is split, as is shown in FIG. 5, into two essentially identical sections so that the tooth 12 can fit inside the head 33. Each head section includes a channel 36, 36' positioned such that the connector channels 36, 36' can be aligned with the tooth channel 30 to form a continuous passage. The head 33 is reversibly attached to the tooth 12 by a pivot pin 32 that projects through the channels 36, 30, 36'. The body 34 extends from the head 33 toward the tail 35, and includes a recession 37, as is shown in FIG. 5, that can accommodate the tooth 12 when the tail 35 of the connector 14 is pivoted toward the power chain 20. Depending on the application, the body 34 may be reinforced for added strength. The tail 35 extends from the body 34, and terminates by angling under the connector 14 to form a hook 38. The angle, depth and length of the hook 38 can vary but must be adequate to allow the hook 38 to engage with the latch 66 of the leading trolley 50, and to retain the engagement as the power chain 20 moves in a forward direction. The body 34 also includes a recessed section 40 which is located between the head 33 and the hook 38. Toward the head end of the recessed section 40 is a stop 39. The stop 39 can vary in depth and length but should be adequate to engage and securely hold the front edge 65 of the leading trolley 50 so that the trolley 50 cannot move forward by the force of its own weight (or the weight of the trolley combined with its load).

Thus, the pusher dog 10 of the present invention incorporates the pivotal functionality, the hook and the recessed stop, similar to that of the prior art drop-forged type pusher dog, but provides a means for affixing this pusher dog to a heavy-duty link chain, thereby allowing the pusher dog of the present invention to be used with an overhead conveyor system that can carry heavier loads than can be carried on a two channel system. Further, because the pusher dog 10 of the present invention incorporates the pivotal functionality, the hook and the recessed stop, similar to that of the prior art drop-forged type pusher dog, this pusher dog can be used with an overhead conveyor system that uses leading trolleys having non-retractable flanges, thus providing a cost savings to the user from an initial cost basis and from an equipment maintenance basis.

It is understood that, in light of a reading of the foregoing description and drawings, those with ordinary skill in the art will be able to make changes and modifications to the present invention without departing from the spirit or scope of the invention, as defined herein.

What is claimed is:

1. A two-track conveyor system comprising:

a) a free track, adapted to support at least one leading load-bearing trolley;

b) a heavy-duty chain drive power track, said power track having an I-beam cross-sectional shape and adapted to support at least one support trolley;

c) a leading load-bearing trolley, including a body mounted to a pair of ball-bearing wheels which fit within and allow said trolley to move within said free track, and said body having a non-retractable flange protruding away from said free track; and d) a chain drive suspended from a plurality of support trolleys adapted to travel along said I-beam, said chain drive being suspended toward said free track, and including 1) a plurality of horizontal links,
2) a plurality of vertical links, secured to said horizontal links with linking pins, and
3) at least one side link chain, substituted for a horizontal link, said side link chain including
   (a) a tooth, securely attached to said side link chain, said tooth having a channel which extends through said tooth and is oriented essentially perpendicular to the length of said side link chain;
   (b) a pivotal connector, including:
      i) a head, the head being split into two essentially identical sections so that a gap sufficiently wide to accommodate said tooth remains between the sections, with each section including a channel positioned such that the channels of the head sections can align with the channel of said tooth,
      ii) a tail forming a hook, and
      iii) a recessed section, adjacent to said hook and extending toward the head, the recessed section including a stop of sufficient depth to engage with the non-retractable flange of the leading trolley; and
   (c) a pivot pin, projecting through the head channels and through the tooth channel such that said tooth is sandwiched between the head sections and is secured to said pivotal connector, but with said pivotal connector remaining moveable relative to said tooth.

2. A pusher dog for use in an overhead conveyor system having a power track and a free track, the power track having a heavy-duty chain drive with a plurality of horizontal and vertical links and being adaptable such that one or more of said pusher dogs can be incorporated at predetermined positions along the drive chain, and the free track being a channel adapted to support at least one leading load-bearing trolley, said trolley including a body mounted to a pair of ball-bearing wheels, and said body having a non-retractable flange protruding toward said power track, the pusher dog comprising:

a) a side link chain, having a length, and adapted to replace one or more of said horizontal links in said drive chain;

b) a tooth, securely attached to said side link chain, said tooth having a channel which extends through said tooth and is oriented essentially perpendicular to the length of said side link chain;

c) a pivotal connector, including:
   1) a head, the head being split into two essentially identical sections so that a gap sufficiently wide to accommodate said tooth remains between the sections, with each section including a channel positioned such that the channels of the head sections can align with the channel of said tooth,
   2) a tail forming a hook, and
   3) a recessed section, adjacent to said hook and extending toward the head, the recessed section including a stop of sufficient depth to engage with the non-retractable flange of the leading trolley; and d) a pivot pin, projecting, through the head channels and through the tooth channel such that said tooth is sandwiched between the head sections and is secured to said pivotal connector, but with said pivotal connector remaining moveable relative to said tooth.

3. The pusher dog of claim 2 further including a linking pin permanently affixed to said side chain link and protruding from said link away from said tooth.

* * * * *